US006645034B1

(12) United States Patent
Tsai

(10) Patent No.: US 6,645,034 B1
(45) Date of Patent: Nov. 11, 2003

(54) MECHANICAL SWINGING DOLL

(76) Inventor: Chih-Cheng Tsai, No. 13, Chung Hwa Rd., Lin Lo Village, Lin Lo Hsiang, Pingtung Hsien (TW)

( * ) Notice: Subject to any disclaimer, the term of this patent is extended or adjusted under 35 U.S.C. 154(b) by 0 days.

(21) Appl. No.: 10/369,654

(22) Filed: Feb. 21, 2003

(51) Int. Cl.[7] ..... A63H 13/12; A63H 3/18

(52) U.S. Cl. ..... 446/322; 446/298; 446/309; 446/353; 40/418

(58) Field of Search ..... 446/34, 35, 297, 446/298, 303, 308, 309, 330, 322, 323, 326, 352–354, 357, 376, 383; 40/418, 419, 420, 423, 414

(56) References Cited

U.S. PATENT DOCUMENTS 153,778 A * 8/1874 Muller et al. ..... 446/322
1,272,304 A * 7/1918 Owens ..... 40/418
5,371,318 A * 12/1994 Hsu et al. ..... 84/95.2
5,424,484 A * 6/1995 Chen ..... 84/95.1

* cited by examiner

*Primary Examiner*—Jacob K. Ackun
*Assistant Examiner*—Bena B. Miller
(74) *Attorney, Agent, or Firm*—Troxell Law Office PLLC

(57) ABSTRACT

A mechanical swing doll has a housing having a first chamber defined therein. A seat is mounted in the housing, and has a second chamber defined at a lower part thereof. A gear assembly is installed in the second chamber. A motor is mounted between the housing and the seat for driving the gear assembly. Two sector gears are respectively provided at two sides of the gear assembly and engaged with the gear assembly. Two shanks are pivotally mounted on the seat and respectively driven by the sector gears. A cloth covering the housing, the seat, and the shanks are hung on a suspender.

14 Claims, 7 Drawing Sheets

MECHANICAL SWINGING DOLL

BACKGROUND OF THE INVENTION

1. Field of the Invention

The present invention is related to a toy, and more particularly to a mechanical swinging doll.

2. Description of Related Art

Movable dolls, such as a mechanical dog, a mechanical Santa Claus, a mechanical fish-like decoration etc., are much more interesting than static dolls, because these movable mechanical dolls have movable body parts and can sing and speak.

Therefore, the invention provides a movable mechanical doll.

SUMMARY OF THE INVENTION

The main objective of the invention is to provide a mechanical doll which can swing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
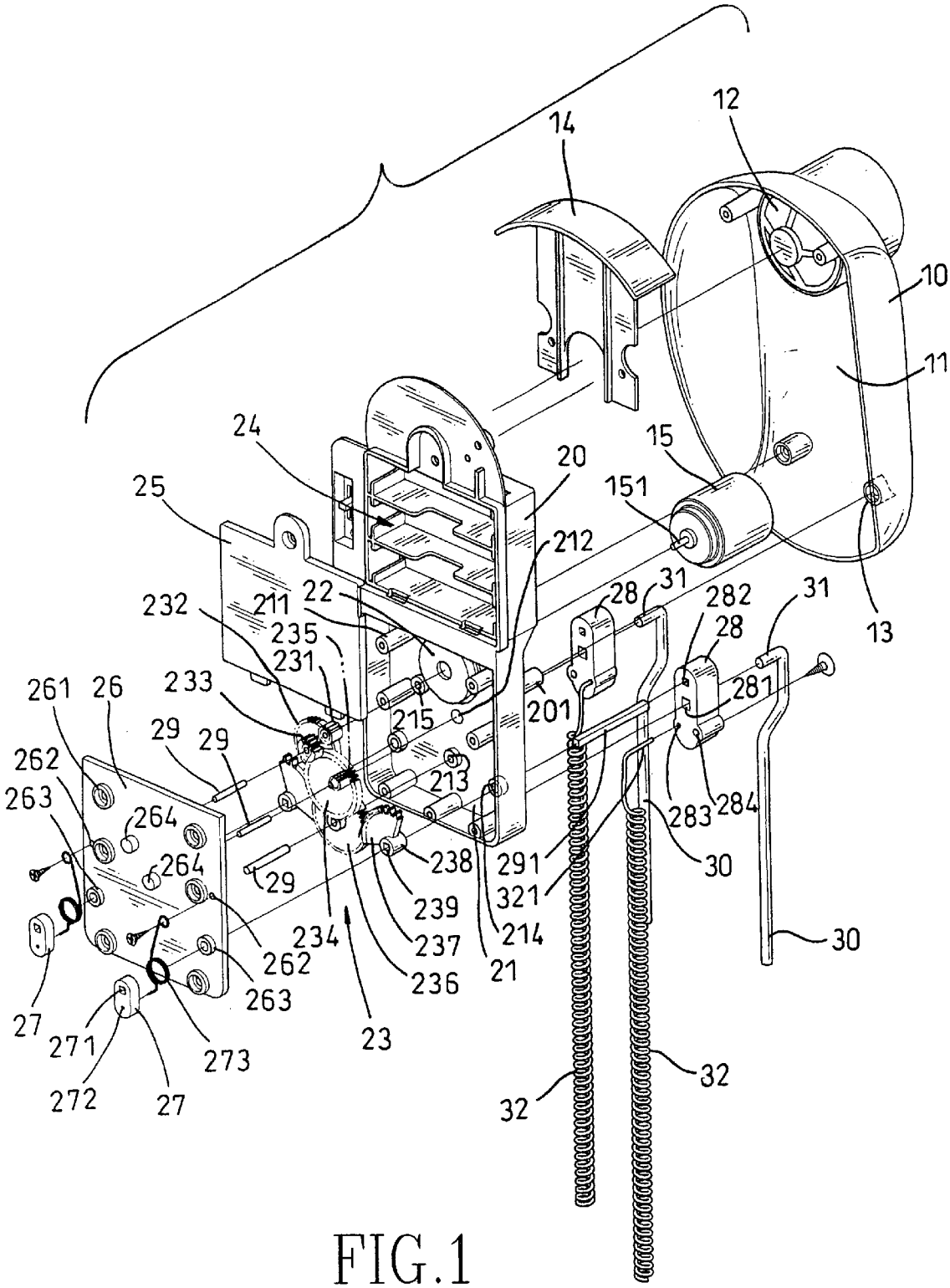
FIG. 1 is an exploded perspective view of a mechanical swinging doll in accordance with the invention.
Figure 6:
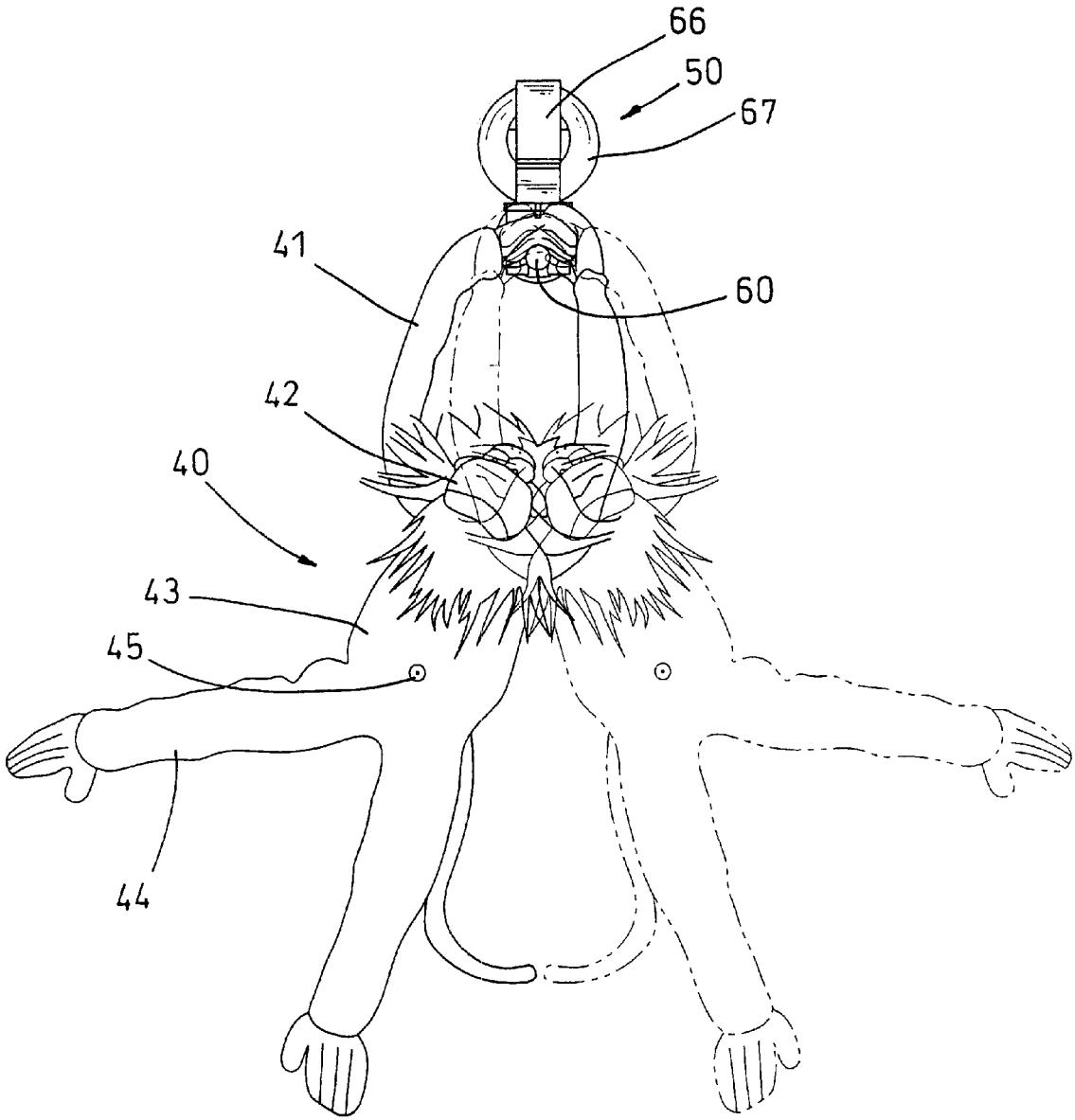
FIG. 6 is a schematic view of the doll covered with a cloth and hung on a suspender to swing.

Referring to FIGS. 1 and 6, a mechanical swinging doll in accordance with the invention is composed of a housing (10), a seat (20) mounted in the housing (10), two shanks (30) movably mounted on the seat (20), an electrical control unit (not shown or numbered) provided between the housing (10) and the seat (20), a cloth (40) provided outside the housing (10), the seat (20) and the shanks (30), and a suspender (50).

The housing (10) has a first chamber (11) defined therein and a plurality of first poles (13) formed in the first chamber (11). A speaker (12) is installed in the first chamber (11), and a board (14) is mounted at an upper portion of the housing (10).

The seat (20) has a plurality of second poles (201) formed at a side facing the first chamber (11) and respectively inserted in the first poles (13). The second poles (201) each have a threaded hole (not shown or numbered) defined therethrough, and screws are inserted from the first poles (13) and engaged in the second poles (201) to fasten the seat (20) in the first chamber (11).

The seat (20) has a second chamber (21) at a lower part thereof for receiving a gear assembly (23), and a battery chamber (24) at an upper part thereof for installing batteries to supply power. A battery cover (25) is detachably mounted on the seat (20) for closing the battery chamber (24).

A motor seat (22) is formed in the second chamber (21). A motor (15) is mounted in the motor seat (22) and between the housing (10) and the seat (20), and has an output axle (151) extending through the motor seat (22) towards the second chamber (21).

The gear assembly (23) has a first gear (231) mounted on the output axle (151) of the motor (15). A second gear (232) is engaged with the first gear (231), and a third gear (233) is integrally formed on the second gear (232) at a side away from the motor seat (22). The second gear (232) and the third gear (233) are coaxially provided on an axle (29). A fourth gear (234) is engaged with the third gear (233), and a fifth gear (235) is integrally formed on the fourth (234) at a side adjacent the motor seat (22). The fourth gear (234) and the fifth gear (235) are coaxially provided on another axle (29). A sixth gear (236) is engaged with the fifth gear (235), and provided on another axle (29). Two sector gears (237) are respectively provided at two sides of the sixth gear (236) and engaged with the sixth gear (236).

A plurality of third poles (211) is formed in the second chamber (21), and a first recess (212), a second recess (213) and a third recess (215) are defined in the second chamber (21). Two openings (214) are respectively defined through the second chamber (21). A back cover (26) is provided on the seat (20) to close the second chamber (21), and a plurality of first tubes (261) and two second tubes (263) are provided through the back cover (26), wherein the first tubes (261) are respectively aligned with the third poles (211), and the second tubes (263) are respectively aligned with the openings (214). Two first threaded apertures (262) are defined through the back cover (26), and two protrusions (264) are formed on an outer surface of the back cover (26), and two fourth recesses (not shown or numbered) are respectively defined in the protrusions (264) at an inner surface of the back cover (26).

The axles (29) through the second and third gears (232, 233) and through the fourth and fifth gears (234,235) have first ends respectively received in the third recess (215) and the first recess (212), and second ends received in the respective fourth recesses of the protrusions (264). The axle (29) through the sixth gear (236) has a first end received in the second recess (213). The sector gears (237) each have a pivoting part (238) with a first polygonal hole (239), and two shafts (291) each with a polygonal section are respectively inserted through the openings (214), the polygonal holes (239) and the second tubes (263) to pivotally mount the sector gears (237) in the second chamber (21).

Two first blocks (27) are mounted outside the back cover (26), and each have a second polygonal hole (271) and a first orifice (272) defined therethrough. The first ends of the shafts (291) extended through the second tubes (263) are respectively inserted in the second polygonal holes (271) to enable the first blocks (27) to pivot along with the sector gear (237). Two torsional springs (273) are respectively provided outside the second tubes (263), and each have a lower end inserted in the respective first orifice (272), and an upper end fastened by a screw engaged in the respective first threaded aperture (262).

Two second blocks (28) are mounted on a side of the seat (20) facing the housing (10), and each have a hook hole (281), a third polygonal hole (282), a second orifice (283), and a second threaded aperture (284) defined therethrough. The second ends of the shafts (291) extended through the openings (214) are respectively inserted in the third polygonal holes (282) to enable the second blocks (28) to pivot along with the sector gear (237).

The shanks (30) are respectively mounted on the second blocks (28), and each have a first hook (31) formed at an upper end thereof and inserted in the hook hole (281) of the respective second block (28). Two springs (32) are respectively provided outside the shanks (30), and each have a second hook (321) inserted in the respective second orifice (283). Two dished screws (not numbered) are respectively engaged in the second threaded apertures (284) to push against the second hook (321).

Figure 2:
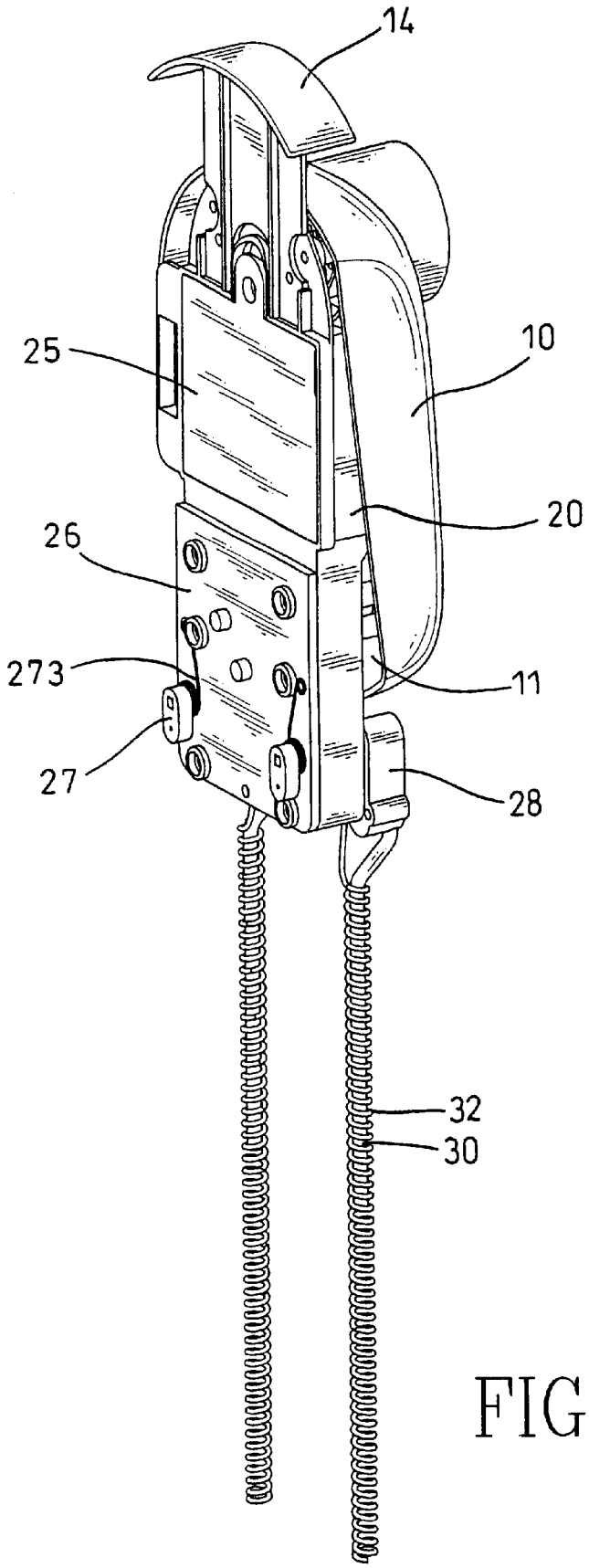
FIG. 2 is a perspective view of the mechanical swinging doll of FIG. 1.
Figure 3:
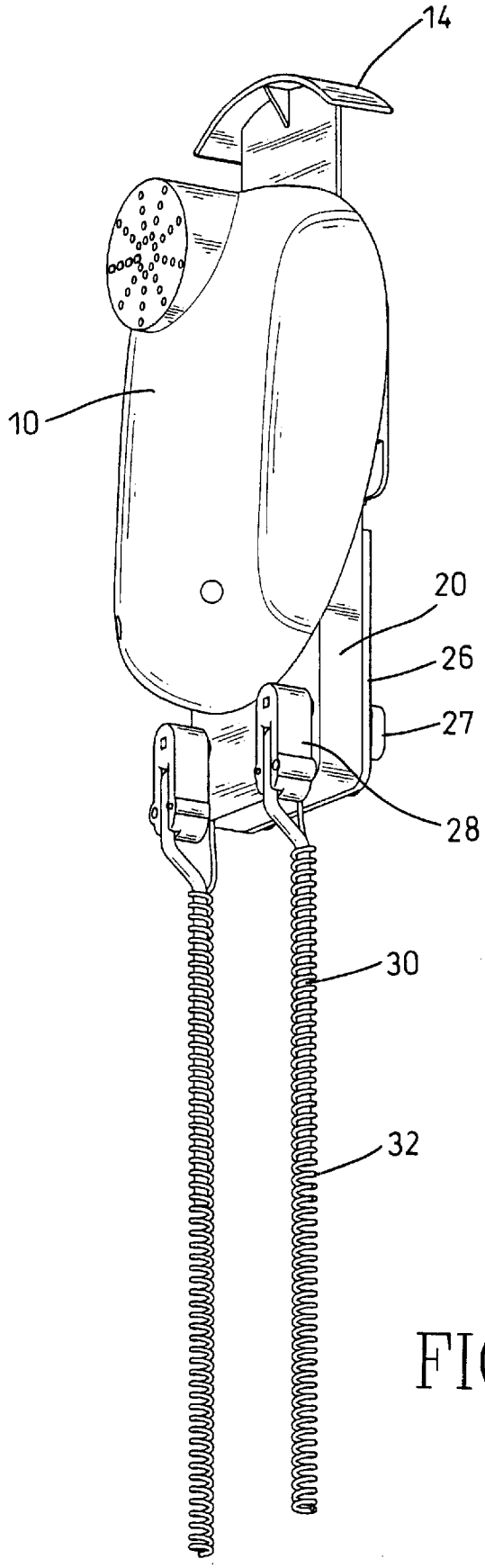
FIG. 3 is another perspective view of the mechanical swinging doll from another visual angle.

The assembled swinging doll of the invention is illustrated in FIGS. 2 and 3.

Figure 4:
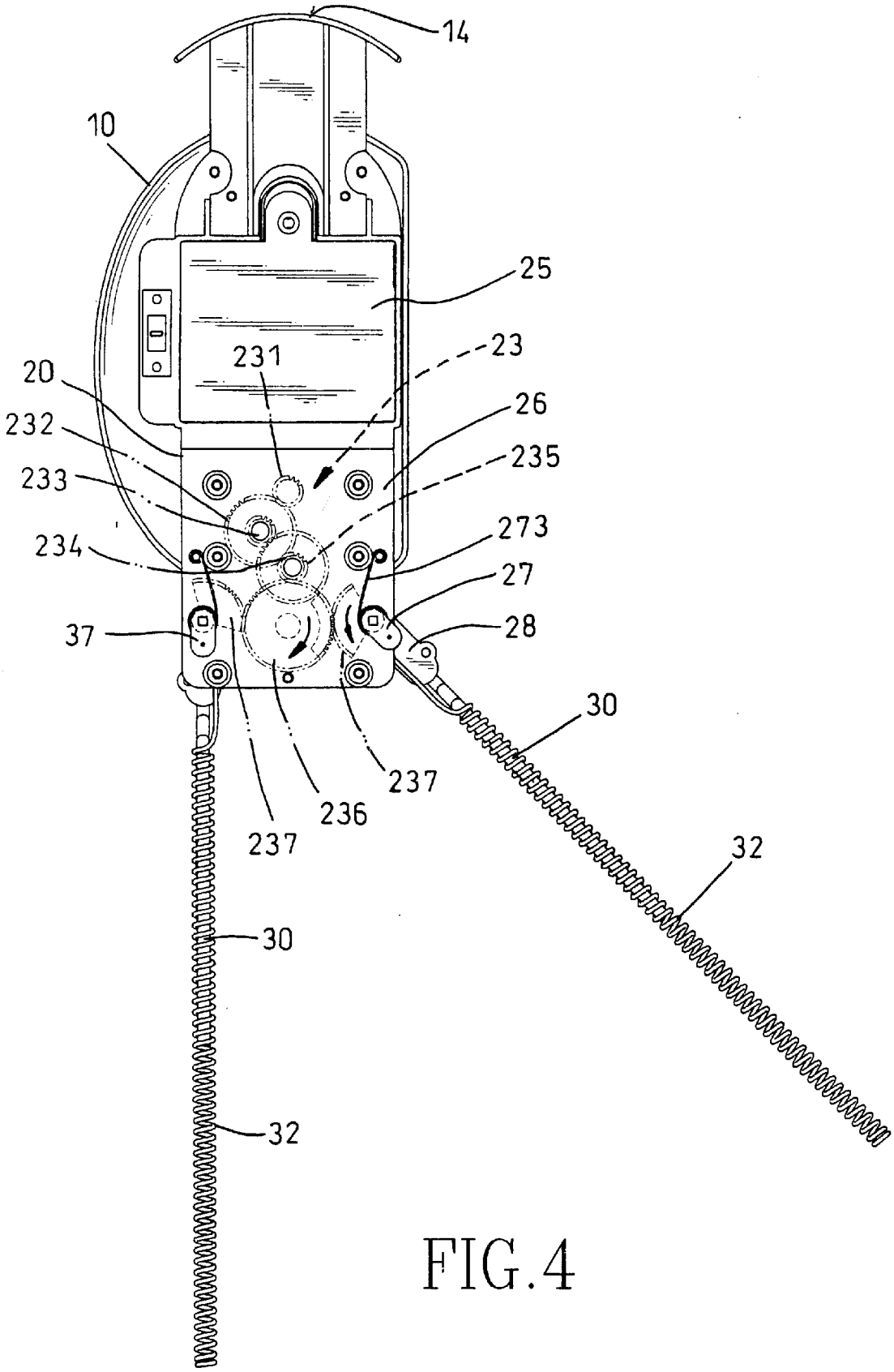
FIG. 4 is a schematic view of a right shank of the doll pivoted outwards.
Figure 5:
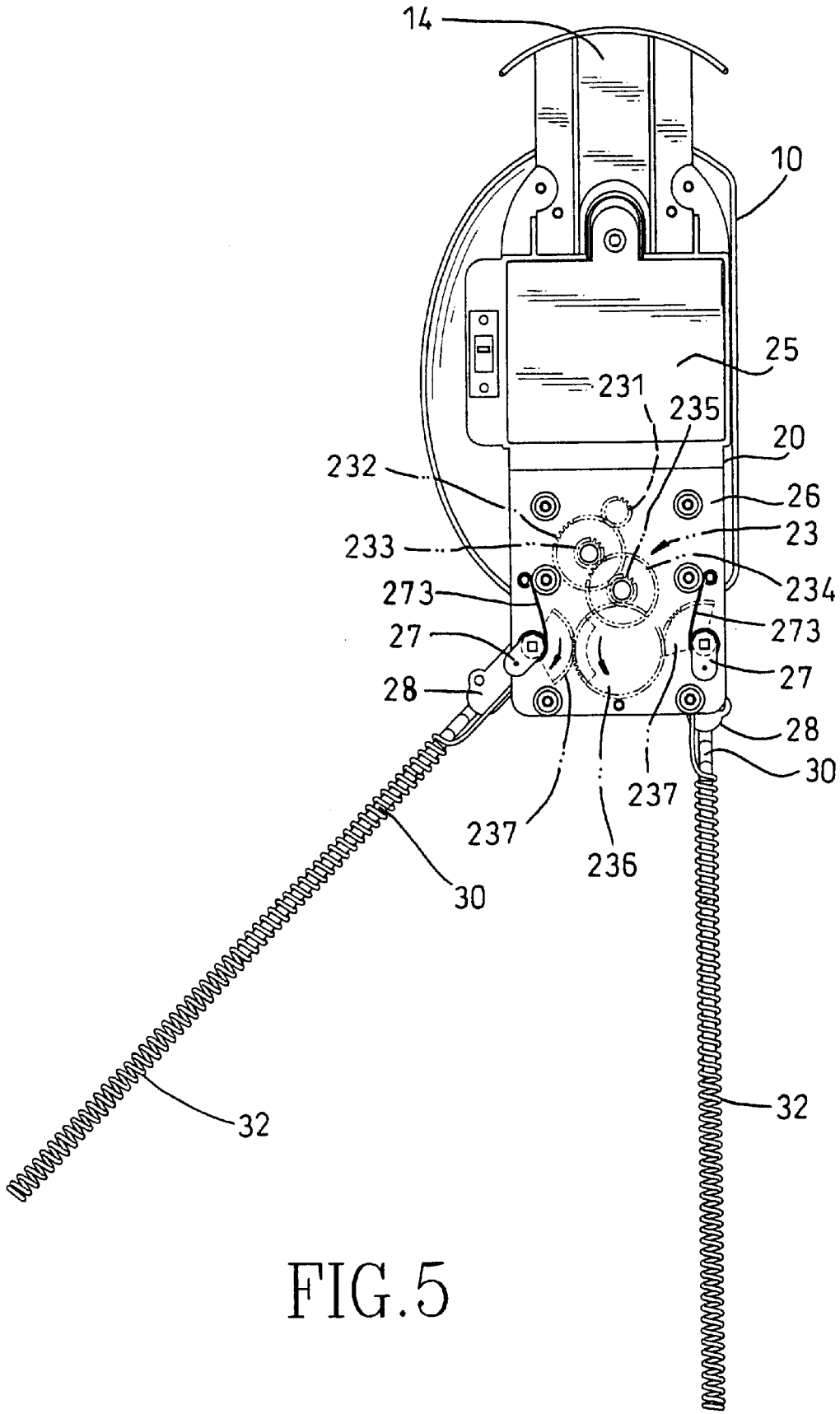
FIG. 5 is a schematic view of a left shank of the doll pivoted outwards.

Referring to FIGS. 4 and 5, when the motor (15) is actuated to rotate, the shanks (30) can be driven to pivot outwards.

When the motor (15) is actuated to drive the sixth gear (236) to rotate clockwise, as shown in FIG. 4, the right sector gear (237) and the right shaft (291) are driven to rotate counter-clockwise. Therefore, the right first block (27), the right second block (28) and the right shank (30) are pivoted outwards, and the right torsional spring (273) is tensioned. When the right sector gear (237) is disengaged from the sixth gear (236), under the force of the right torsional spring (273), the right shank (30) is pivoted inwards to return to the original position.

Thereafter, the motor (15) drives the sixth (236) to rotate counterclockwise, as shown in FIG. 5, the left sector gear (237) and the left shaft (291) are driven to rotate clockwise. Therefore, the left first block (27), the left second block (28) and the left shank (30) are pivoted outwards, and the left torsional spring (273) is tensioned. When the left sector gear (237) is disengaged from the sixth gear (236), under the force of the left torsional spring (273), the left shank (30) is pivoted inwards to return to the original position.

Referring to FIG. 6, the cloth (40) formed like a monkey has a slot (not shown or numbered) defined at a back opposite to the belly (43) of the monkey, and the mechanical device of the doll is inserted in the cloth (40) through the slot. The shanks (30) are respectively inserted in the legs of the monkey, and the board (14) is inserted in the head (42) of the monkey. The monkey further has two arms (41) lifting upwards, and the hands are adhered to each other and hung on a bar (60) of the suspender (50). A microphone (45) is provided in the cloth (40) and electrically connected with the electrical control unit. When the microphone (45) receives some sound, the motor (15) is actuated to alternately pivot the shanks (30) and the legs (44), and the monkey begins to swing about the bar (60).

Figure 7:
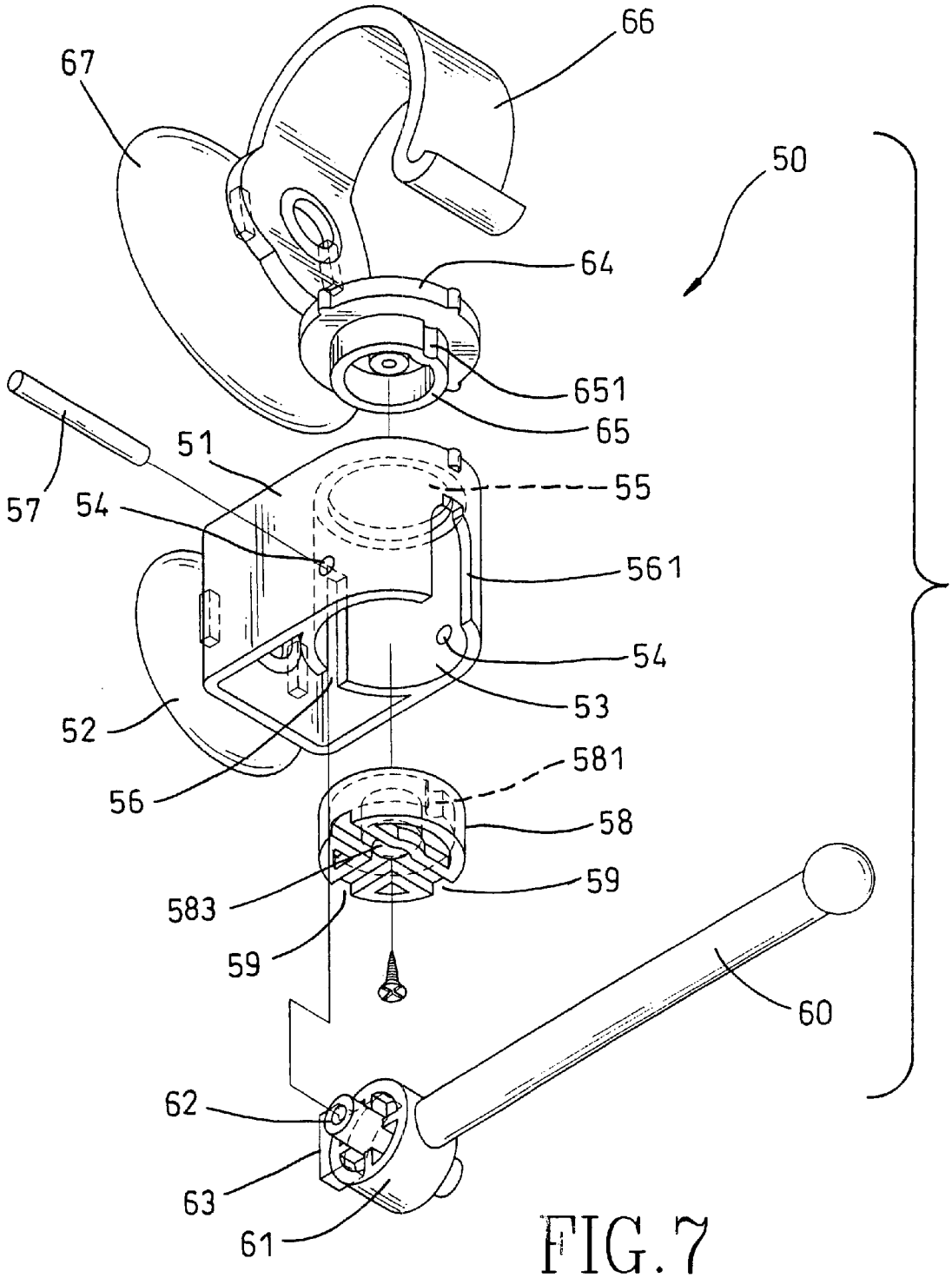
FIG. 7 is an exploded perspective view of the suspender in FIG. 6.

Referring to FIG. 7, the suspender (50) has a positioning seat (51) with a third chamber (53). A first sucker (52) is formed at a rear side of the positioning seat (51). A first channel (56) and a second channel (561) are longitudinally defined at diametrically opposite sides of the third chamber (53). An upper hole (55) is defined at a top of the third chamber (53), and two pin holes (54) are radially defined through an outer periphery of the third chamber (53).

A pothook (66) is mounted on the top of the positioning seat (51). The pothook (66) has a first disk (64) formed at a bottom thereof, and a second sucker (67) at a rear side thereof. A ring (65) is formed on a bottom of the first disk (64) and received in the upper hole (55). A second disk (58) is received in the third chamber (53) from the bottom to fasten the pothook (66) by a screw inserted through a hole (583) of the second disk (58). A notch (651) is defined at an outer periphery of the ring (65), and a lug (581) is formed in the second disk (58) and is located in the notch (651) to position the ring (65) in the second disk (58).

A T-like channel (59) is defined at a bottom of the second disk (58). The bar (60) located in the second channel (561) has a pivoting end (61) received in the third chamber (53). The pivoting end (61) has two ears (62) respectively formed at two sides thereof and a nose (63) formed at a rear side thereof. The ears (62) and the nose (63) are received in the T-like channel (59) of the second disk (58). The ears (62) are aligned with the pin holes (54), and a pin (57) is inserted through the pin holes (54) and the ears (62) to pivotally mount the bar (60) in the positioning seat (51). The nose (63) is located in the first channel (56) of the third chamber (53).

By attaching the suckers (52, 67) on a wall or hitching the pothook (66), the suspender (50) can be secured for hanging the doll.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mechanical swinging doll comprising:

a housing (10) having a first chamber (11) defined therein;

a seat (20) mounted in the housing (10), the seat (20) having a second chamber (21) at a lower part thereof, a gear assembly (23) installed in the second chamber (21), a motor (15) mounted between the housing (10) and the seat (20), an output axle (151) of the motor (15) extending towards the second chamber (21) for driving the gear assembly (23), two sector gears (237) respectively provided at two sides of the gear assembly (23) and engaged with the gear assembly (23);

an electrical control unit provided between the housing (10) and the seat (20);

two shanks (30) pivotally mounted on the seat (20) and respectively driven by the sector gears (237); and a cloth (40) covering the housing (10), the seat (20), and the shanks (30) therein and hung on a suspender (50).

2. The mechanical swinging doll as claimed in claim 1, wherein the housing (10) has a plurality first poles (13) formed in the first chamber (11), and the seat (20) has a plurality of second poles (201) formed at a side facing the first chamber (11) and respectively inserted in the first poles (13) to fasten the seat (20) in the first chamber (11) by screws engaged in the first and second poles.

3. The mechanical swinging doll as claimed in claim 1, wherein the housing (10) further has a speaker (12) installed in the first chamber (11), and a board (14) mounted at an upper portion of the housing (10).

4. The mechanical swinging doll as claimed in claim 1, wherein the seat (20) has a motor seat (22) formed in the second chamber (21), and the motor (15) is mounted in the motor seat (22).

5. The mechanical swinging doll as claimed in claim 1, wherein the seat (20) has a battery chamber (24) at an upper part thereof for installing batteries to supply power, and a battery cover (25) detachably mounted on the seat (20) for closing the battery chamber (24).

6. The mechanical swinging doll as claimed in claim 1, wherein the gear assembly (23) has a first gear (231)

mounted on the output axle (151) of the motor (15), a second gear (232) engaged with the first gear (231), a third gear (233) integrally formed on the second gear (232) at a side away from the motor (15), a fourth gear (234) engaged with the third gear (233), a fifth gear (235) integrally formed on the fourth (234) at a side adjacent the motor seat (22), a sixth gear (236) engaged with the fifth gear (235) and engaged with the two sector gears (237).

7. The mechanical swinging doll as claimed in claim 6, wherein the seat (20) has a plurality of third poles (211) formed in the second chamber (21), two openings (214) defined through the second chamber (21), a back cover (26) provided on the seat (20) to close the second chamber (21), a plurality of first tubes (261) and two second tubes (263) provided through the back cover (26), wherein the first tubes (261) are respectively aligned with the third poles (211), and the second tubes (263) are respectively aligned with the openings (214), and two first threaded apertures (262) defined through the back cover (26).

8. The mechanical swinging doll as claimed in claim 7, wherein the sector gears (237) each have a pivot part (238), two shafts (291) are respectively inserted through the openings (214), the polygonal holes (239) and the second tubes (263) to pivotally mount the sector gears (237) in the second chamber (21), two first blocks (27) are provided at the first ends of the shafts (291) through the second tubes (263), two second blocks (28) are provided at the second ends of the shafts (291) through the openings (214); and the shanks (30) are respectively mounted on the second blocks (28).

9. The mechanical swinging doll as claimed in claim 8, wherein the pivoting parts (238) each have a first polygonal hole (239), and the shafts (291) each have a polygonal section.

10. The mechanical swinging doll as claimed in claim 8, wherein the first blocks (27) each have a second polygonal hole (271) and a first orifice (272) defined therethrough, the first ends of the shafts (291) are respectively inserted in the second polygonal holes (271); two torsional springs (273) are respectively provided outside the second tubes (263), and each have a lower end inserted in the respective first orifice (272) and an upper end fastened by a screw engaged in the respective first threaded aperture (262).

11. The mechanical swinging doll as claimed in claim 8, wherein the second blocks (28) each have a hook hole (281), and a third polygonal hole (282); the second ends of the shafts (291) are respectively inserted in the third polygonal holes (282); and the shanks (30) each have a first hook (31) formed at an upper end thereof and inserted in the hook hole (281) of the respective second block (28).

12. The mechanical swinging doll as claimed in claim 11, wherein the second blocks (28) each have a second orifice (283), and a second threaded aperture (284) defined therethrough; two springs (32) are respectively provided outside the shanks (30) and each have a second hook (321) inserted in the respective second orifice (283); and two dished screws are respectively engaged in the second threaded apertures (284) to push against the second hook (321).

13. The mechanical swinging doll as claimed in claim 1, wherein the cloth (40) has a microphone (45) provided therein and electrically connected with the electrical control unit.

14. The mechanical swinging doll as claimed in claim 1, wherein the suspender (50) comprises a positioning seat (51) having a third chamber (53) define therein, a first sucker (52) formed at a rear side thereof, a first channel (56) and a second channel (561) longitudinally defined at diametrically opposite sides of the third chamber (53), an upper hole (55) defined at a top of the third chamber (53), and two pin holes (54) radially defined through an outer periphery of the third chamber (53);

a pothook (66) mounted on the top of the positioning seat (51), the pothook having a first disk (64) formed at a bottom thereof, a second sucker (67) at a rear side thereof, a ring (65) formed on a bottom of the first disk (64) and received in the upper hole (55), and a notch (651) defined at an outer periphery of the ring (65);

a second disk (58) received in the third chamber (53) from the bottom to fasten the pothook (66) by a screw inserted through a hole (583) of the second disk (58), a lug (581) formed in the second disk (58) and located in the notch (651) to position the ring (65) in the second disk (58), and a T-like channel (59) defined at a bottom of the second disk (58); and a bar (60) located in the second channel (561), the bar (60) having a pivoting end (61) received in the third chamber (53), two ears (62) respectively formed at two sides of the pivoting end (61) and a nose (63) formed at a rear side of the pivoting end (61), the ears (62) and the nose (63) received in the T-like channel (59), the nose (63) located in the first channel (56) of the third chamber (53), and the ears (62) aligned with the pin holes (54) for a pin (57) inserted through the pin holes (54) and the ears (62) to pivotally mount the bar (60) in the positioning seat (51).

* * * * *